US006878302B1

(12) United States Patent
Corbellini et al.

(10) Patent No.: US 6,878,302 B1
(45) Date of Patent: Apr. 12, 2005

(54) METHOD OF POLISHING WAFERS

(75) Inventors: Paride Corbellini, Trecate (IT); Giovanni Negri, Sizzano (IT); Ezio Bovio, Bellinzago Novarese (IT); Luca Moiraghi, Milan (IT)

(73) Assignee: MEMC Electronic Materials, SpA, Novara (IT)

( * ) Notice: Subject to any disclaimer, the term of this patent is extended or adjusted under 35 U.S.C. 154(b) by 0 days.

(21) Appl. No.: 10/239,669

(22) PCT Filed: Mar. 30, 2000

(86) PCT No.: PCT/IT00/00115

§ 371 (c)(1),
(2), (4) Date: Dec. 3, 2002

(87) PCT Pub. No.: WO01/74532

PCT Pub. Date: Oct. 11, 2001

(51) Int. Cl.[7] ..... H01L 21/302

(52) U.S. Cl. ..... 216/88; 438/5; 438/692; 451/5; 451/57

(58) Field of Search ..... 216/88, 89; 438/692, 438/693; 451/5, 57

(56) References Cited

U.S. PATENT DOCUMENTS 4,918,869 A 4/1990 Kitta
5,664,987 A 9/1997 Renteln
5,730,642 A 3/1998 Sandhu et al.
5,934,974 A * 8/1999 Tzeng ..... 451/6
6,616,513 B1 * 9/2003 Osterheld ..... 451/56

FOREIGN PATENT DOCUMENTS

JP 05-315307 * 11/1993
WO WO 96/36459 A1 11/1996
WO WO 97/25660 A1 7/1997

OTHER PUBLICATIONS

International Search Report from the European Patent Office dated Mar. 20, 2001(mailed Apr. 4, 2001).

* cited by examiner

*Primary Examiner*—George A. Goudreau
(74) *Attorney, Agent, or Firm*—Senniger Powers

(57) ABSTRACT

The method comprises the steps of mounting a first wafer (13) on the mounting member (12) and securing the mounting member to the hub (16) by drawing a vacuum at a first vacuum pressure through the hub; rotating the hub about the hub axis (AH), rotating a polishing pad (34) mounted on the turntable (30) about the turntable axis (at), and bringing a surface of the wafer (13) and the polishing pad into contact with each other. The wafer (16) is demounted, and the shape of the polished wafer is determined. A second vacuum pressure is selected using the information obtained. A successive wafer is polished according to the same method as the first wafer except that the second vacuum pressure is substituted for the first vacuum pressure. The second vacuum pressure is sufficient to deform the mounting member (12) thereby deform the wafer to improve the flatness and parallelism of the surfaces of the successive wafer.

17 Claims, 1 Drawing Sheet

METHOD OF POLISHING WAFERS

BACKGROUND OF THE INVENTION

The present invention relates generally to methods of processing semiconductor waters, and more particularly to a method of chemical mechanical polishing (CMP) for semiconductor wafers.

In a conventional chemical mechanical polishing apparatus, a semiconductor wafer is adhered to a polishing block (broadly, "mounting member") of the apparatus. The polishing block is typically held on a hub of the apparatus by vacuum pressure. The wafer is rotated on the hub and forced downward by the hub against a rotating polishing pad which is mounted on a turntable. Heat and pressure created during the polishing process may deform the polishing block and/or the pad into a slightly concave or convex shape during polishing. Additionally, the pad shape and the pad surface characteristics may change after processing a number of wafers. The charge in shape of the block and the change in shape or surface of the pad can cause the downward pressure exerted on the wafer by the hub to be non-uniform over the wafer surface and thereby affect flatness and parallelism of the surfaces of the polished wafer. It is known in the art that adjusting the vacuum pressure on the polishing block can deform the block and the wafer in ways which tend to counteract the deformation of the block or pad caused by other factors and thereby maintain the flatness and parallelism of the wafer. However, the conventional method of adjusting vacuum pressure relies on the skill and experience of the operator to determine the amount of adjustment and is not dictated by a predetermined procedure. Therefore, the results of this manipulation are not consistent.

The polishing pad of the chemical mechanical polishing apparatus is relatively expensive and must be of high quality to produce wafers of satisfactory flatness and roughness. During polishing, the wafer and pad are rotating at different velocities and their axes are not concentric. As a result, portions of the pad are contacted more often than ocher portions by the wafer material, and wearing (or "aging") of the pad becomes uneven. Such uneven pad wear affects the flatness and parallelism of the polished wafers so that the pad must be replaced prematurely in order to maintain wafer flatness and parallelism.

SUMMARY OF THE INVENTION

Among the several objects and features of the present invention may be noted the provision of a method of polishing semiconductor wafers which produces flat wafers; the provision of such a method which produces wafers having parallel surfaces; the provision of such a method which adapts to changing conditions to maintain flatness and parallelism and the provision of such a method which improves the uniformity of wear of the polishing pad.

Briefly, in a method of the invention, semiconductor wafers are polished in a polishing apparatus including a mounting member, a hub having a central hub axis, and a turntable having a central turntable axis offset from the hub axis. The method generally comprises the steps of mounting a first wafer on the mounting member and securing the mounting member to the hub by drawing a vacuum at a first vacuum pressure through the hub. The first vacuum pressure is held constant during polishing. The method further comprises rotating the hub about the hub axis, rotating a polishing pad mounted on the turntable about the turntable axis, and bringing a surface of the wafer and the polishing pad into contact with each other for polishing a surface of the wafer. The wafer is demounted after polishing of the wafer is complete, and the shape of the polished wafer is determined. A second vacuum pressure is selected using information obtained from determining the shape of the first wafer. A successive wafer is polished according to the same method as the first wafer except that the second vacuum pressure is substituted for the first vacuum pressure. The second vacuum pressure is sufficient to deform the mounting member and thereby deform the wafer to improve the flatness and parallelism of the surfaces of the successive wafer.

In another aspect of the present invention, a method generally comprises mounting a first wafer on the mounting member, securing the mounting member to the hub and selecting a hub velocity for the first wafer. The hub is rotated about the hub axis at the hub velocity and the hub velocity is maintained substantially constant during polishing of the first wafer. A polishing pad mounted on the turntable is rotated about the turntable axis at a constant turntable velocity. A surface of the first wafer and the polishing pad are brought into contact with each other for polishing a surface of the wafer. The first wafer is demounted after polishing of the wafer is complete. Successive wafers are processed using the method of the first wafer except that the method for successive wafers includes selecting a new hub velocity for at least one of the successive wafers and rotating the hub about the hub axis at the new hub velocity. The new hub velocity differs from the hub velocity selected for a preceding wafer such that the polishing pad is worn substantially symmetrically about the hub axis during polishing of the successive wafers to thereby extend the useful life of the polishing pad and maintain the flatness of the wafers produced.

In yet another aspect of the present invention, the apparatus further includes a computer connected electronically to a measuring machine. The method comprises the steps of mounting a first wafer on the mounting member and securing the mounting member to the hub by drawing a vacuum at a first vacuum pressure through the hub. The computer selects the first vacuum pressure. The hub is rotated about the hub axis and a polishing pad mounted on the turntable is rotated about the turntable axis. A surface of the wafer and the polishing pad are brought into contact with each other for polishing a surface of the wafer. The wafer is demounted after polishing of the wafer is complete and the roll-off value of the polished wafer is determined using the measuring machine. The measuring machine signals the roll-off value to the computer. The computer automatically selects a second vacuum pressure using the roll-off value of the first wafer. The processing steps are repeated for a successive wafer except that a second vacuum pressure is substituted for the first vacuum pressure. The second vacuum pressure is sufficient to deform the mounting member and thereby deform the wafer to improve the flatness and parallelism of the surfaces of the successive wafer.

Other objects and features of the present invention will be in part apparent and in part pointed out hereinafter.

BRIEF DESCRIPTION OF THE DRAWING

Corresponding reference characters indicate corresponding parts throughout the several views of the drawings.

DETAILED DESCRIPTION OF THE PREFERRED EMBODIMENT

Figure 1:
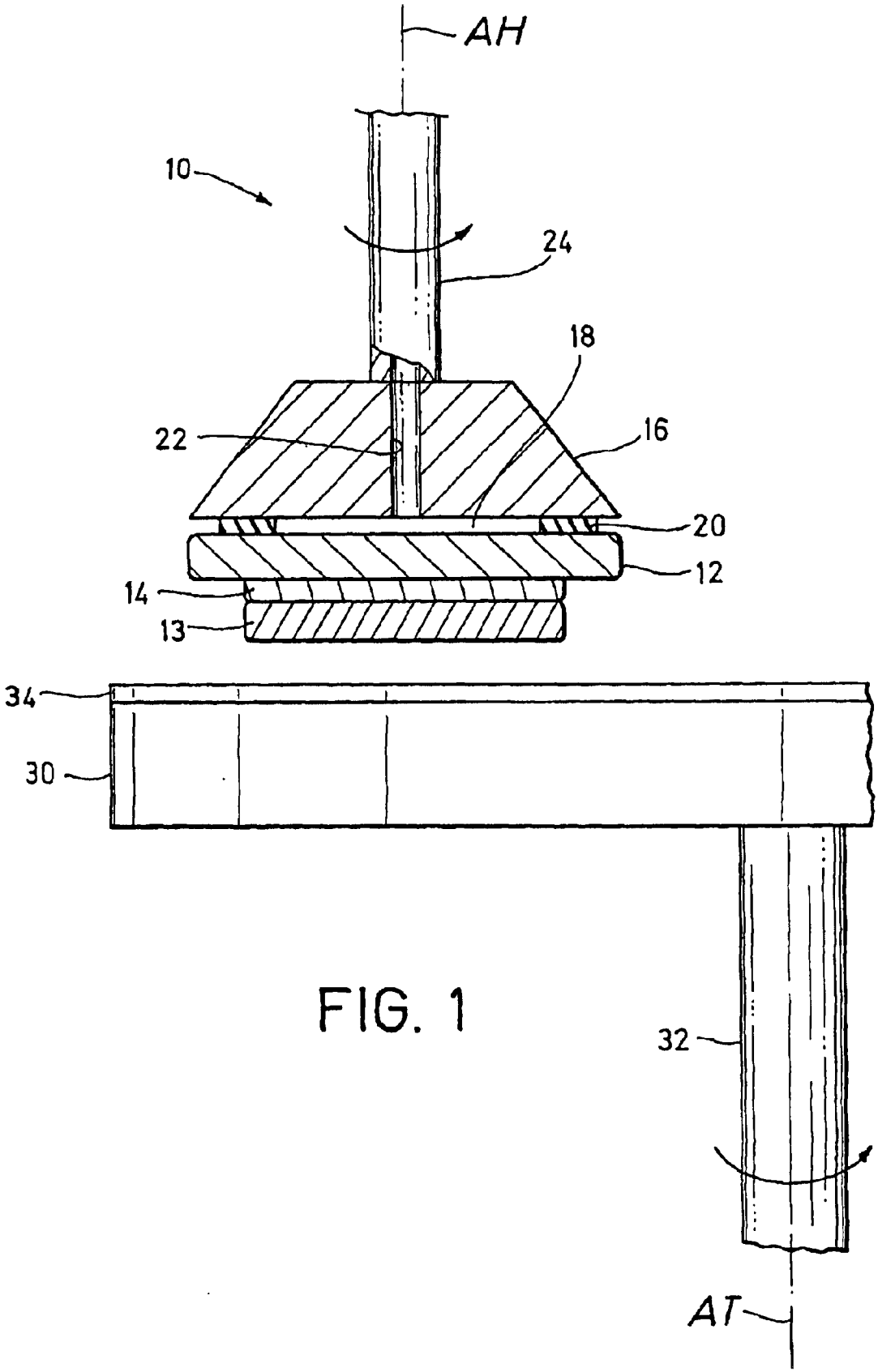
FIG. 1 is a partial cross-section of a polishing apparatus.

Referring now to FIG. 1, a fragmentary portion of a chemical mechanical polishing apparatus is schematically shown and referred to generally as 10. A suitable polishing apparatus is Model MK9J, available from Strasbaugh, San Luis Obispo, Calif. though the use of this invention with other polishing apparatus is contemplated. Note that the apparatus described herein is a single-wafer polishing apparatus. However, it is contemplated that the method of this invention may be used in a multi-wafer polishing apparatus. The portions of the apparatus 10 which are well known in the art will only be briefly described. A polishing block 12 (broadly, "mounting member") mounts a wafer 13 which is affixed to the block by a layer of wax 14 or by other suitable method known in the art. The polishing block 12 is conventionally made of a material, such as silicon carbide or a ceramic material, which is substantially rigid. The polishing block 12 is adapted to be held on a rotatable hub 16 by vacuum pressure. In operation, a vacuum chamber 18 may be formed in a space defined by the block, hub and a donut-shaped ring 20 which is attached to the hub and is engaged with the block. The chamber 18 is in fluid communication through a vacuum port 22 of the hub 16 to a pump or other suitable mechanism for drawing air out of the chamber. A shaft 24 extends from the center of the hub 16 and is concentric with a central hub axis AH of the hub 16. The shaft is suitably connected to a conventional drive mechanism (not shown) for rotating the hub 16 and for translating the hub vertically. A turntable 30 having a central turntable axis AT is mounted on a shaft 32 which is suitably connected to a separate drive mechanism (not shown) for rotating the turntable. A polishing pad 34 is mounted on the turntable 30. A conventional pad, such as a polyurethane pad or a polyester pad impregnated with urethane fibers, is suitable.

In a first embodiment of the invention, a first wafer 13 is mounted on the polishing block 12 by wax mounting or other suitable mounting method. The polishing block 12 is secured to the hub 16 by drawing a vacuum at a predetermined vacuum pressure through the hub. Preferably, the predetermined vacuum pressure for wafers processed on a new polishing pad is relatively low, and more preferably is the minimum vacuum pressure which is capable of holding the polishing block 12 on the hub (e.g., 50 mmHg for the MK9J model). A new polishing pad 34, such as an MH S 15A pad available from Rodel-Nitta Corporation, Nara, Japan, is mounted on the turntable 30. Preferably, no breaking in of the pad is required such that the first wafer polished on the new pad is of acceptable flatness and smoothness. The hub 16 and wafer 13 are rotated about the hub axis and the turntable 30 and pad 34 are rotated about the turntable axis.

The wafer 13 is moved downward toward the polishing pad 34 and into contact with the polishing pad to polish an exposed surface of the wafer, A polishing slurry, preferably a colloidal silica slurry such as SYTON™ available from E.I. du Pont de Nemours and Co., is supplied to the pad-wafer interface. During polishing, the wafer 13 is rotating about the hub axis AH and the pad 34 is rotating about the turntable axis AT. The axes AH and AT are offset from each other by a distance, for example 120 mm. Typically, the hub oscillates very slightly along an arc passing through the hub axis AR, for example about 1.5 mm. The vacuum pressure on the polishing block 12 is held constant during polishing. The wafer 13 is held against the pad 34 until polishing is complete. Thereafter, the wafer 13 is moved upward, the hub 16 and turntable rotation is stopped, the vacuum pressure is released, and the polishing block 12 is removed from the hub.

The wafer 13 is demounted from the block 12 and is preferably transferred to a measuring machine capable of determining the shape of the wafer. Although the polishing block is substantially rigid on a macroscopic scale, heat and pressure during polishing will microscopically deform the block and wafer mounted thereon contributing to deviations in the shape of the wafer surface from being perfectly flat. A suitable measurement of the shape of the wafer 13 is the roll-off value. As is known to those skilled in the art, the roll-off value indicates the difference in wafer thickness between its center and its edges. The wafer 13 is transferred to a suitable measuring machine either automatically or manually. A suitable machine is a Model ADE 9500 measuring system, made by ADE Corp. of Westwood, Mass., The roll-off value for the wafer 13 is preferably automatically determined by the measuring machine. The roll-off value is positive if the wafer 13 is convex aid is negative if the wafer is concave. The roll-off value is then multiplied by an experimentally determined multiplier (as will be explained in more detail) to obtain a delta pressure, which is added to or subtracted from the predetermined vacuum pressure to determine a second vacuum pressure.

After the second vacuum pressure is selected, a successive wafer 13 is processed according to the method described with respect to the first wafer, with the exception that the second vacuum pressure is used. Using the second vacuum pressure, the polishing block 12 and wafer 13 are sufficiently deformed so that the wafer is more nearly flat after polishing is complete. Further, the surfaces of the wafer 13 are substantially parallel. For example, in tests employing the present method, most wafers produced had roll-off values less than ±0.2 microns.

It is to be noted that a group of wafers 13 may be processed at the first vacuum pressure and measured as described, an average roll-off determined for the group of wafers or certain wafers within the group, and the average roll-off thereafter used to determine the delta pressure. Also, the terms "first wafer" and "successive wafer" are not to be construed to require that the wafer immediately succeeding the first wafer be processed at the second vacuum pressure. A "first wafer" may, for example be the fourth wafer in a group of ten wafers that are all processed at a first vacuum pressure. The delta value and second vacuum pressure may thereafter be determined from the roll-off value of the fourth (so-called "first") wafer, even though the fifth through tenth wafers in the group were already processed at the first vacuum pressure. Preferably, however, the first wafer 13 is measured immediately after polishing, the second vacuum pressure is calculated and the immediately succeeding wafer is polished at the second vacuum pressure.

Preferably, a computer (or multiple computers) control selection of the first vacuum pressure and the second vacuum pressure. For example, a polisher computer (not shown) associated with the polishing apparatus 10 controls processing of each wafer 13 and manages vacuum pressure. The polisher computer is suitably a personal computer and is connected to a central computer, which is suitably a DIGITAL™ (now COMPAQ™) ALPHA™ systems, 1200/533. (An equivalent system is believed to be available from Compaq, Houston, Tex.) The polisher computer signals to the central computer an identification number of a wafer 13 upon completion of polishing by the polishing apparatus. Suitable identification means, such as radio frequency identification tags and antennas, are used to identify each wafer 13. The wafer is thereafter sent either manually or automatically for determining the roll-off value of the wafer. The measuring machine, which is connected to the central computer, signals to the central computer the roll-off value for the wafer 13, and the central computer transfers the value to the polisher computer. The polisher computer is preferably pre-programmed to calculate the delta pressure from the roll-off value and to adjust the vacuum pressure accordingly for the next wafer. It is contemplated that a single computer be used to perform the functions of both the central computer and polisher computer.

The multiplier is obtained empirically. For example, a suitable experiment included processing a water 13 as described above at a predetermined vacuum pressure. The roll-off value was measured and was found to be negative, meaning the wafer 13 was concave in surface shape. The value was multiplied by a test multiplier (the multiplier is always negative) and the delta pressure obtained therefrom was added to the vacuum pressure. The next wafer in the experiment was processed at the first test vacuum pressure. The roll-off value for the wafer 13 was found to be positive, meaning the wafer was convex. Thus, the correction was too great, and the test multiplier was therefore reduced. This procedure was repeated until a multiplier which produced a flat wafer was determined. Further experiments of this type were performed, and it was established that the correct multiplier is not constant. For example, the following multipliers were experimentally determined for the process using the MK9J 6DZ machine, an MH S 15A polishing pad having a diameter of 21 inches, SYTON™ colloidal silica slurry, a 200 mm diameter wafer and a silicon carbide polishing block:

| ROLL-OFF VALUE | MULTIPLIER |
|---|---|
| less than −0.6 | −400 |
| between −0.6 and −0.2 | −250 |
| between −0.2 and 0 | −180 |
| between 0 and 0.2 | −50 |
| between 0.2 and 0.6 | −100 |
| greater than 0.6 | −200 |

Where the roll-off value is exactly ±0.2 or ±0.6, the lower range multiplier is preferably selected. It is contemplated that the ranges may be further optimized with more testing.

In a second embodiment of the invention, a first wafer 13 is mounted on the polishing block 12 by wax mounting or other suitable mounting method. The polishing block 12 is preferably secured to the hub 16 by drawing a vacuum at a predetermined vacuum pressure through the hub. Preferably, a new polishing pad 34 is mounted on the turntable 30 for polishing the first wafer 13. Also preferably, the predetermined vacuum pressure (which is an initial vacuum pressure) is relatively low, as described above. An initial hub velocity is selected for the first wafer 13 as will be described in more detail hereinafter. The hub 16 is rotated about its axis at the selected velocity, and the hub velocity is maintained substantially constant during polishing of the wafer 13. The turntable 30 and pad 34 are also rotated about the turntable axis at a constant turntable velocity.

The wafer 13 is moved downward toward the polishing pad 34 and into contact with the polishing pad to polish a surface of the wafer. The polishing slurry is supplied to the pad-wafer interface. The vacuum pressure is preferably held constant during polishing. The wafer 13 is held against the pad 34 until polishing is complete. Thereafter, the wafer 13 is moved upward, the hub 16 and turntable rotation is stopped, the vacuum pressure is released, and the polishing block 12 is removed from the hub. The wafer 13 is demounted from the block 12 and a new hub velocity is selected for a successive wafer as will be described in more detail. The method of the second embodiment is repeated for the second wafer 13. Preferably, the first wafer is transferred to the measuring machine for determination of a second vacuum pressure and the second vacuum pressure is substituted for the predetermined vacuum pressure for processing the successive wafer 13 as described with respect to the first embodiment.

Now turning to a preferred method of selecting the hub velocity, an optimum hub velocity at which the polishing pad 34 is theoretically worn symmetrically about the hub axis AH is mathematically determined. This mathematical determination assumes that wear of any particular point on the pad 34 relates to the amount of wafer material contacted or "seen" at that point. Note that oscillation of the hub axis (which is very small for the MK9J polishing apparatus) is neglected in the mathematical determination. The amount of material seen by various points on the pad is determined by plotting the trajectory of generic points P on the wafer 13 using the formulas:

$$x_p(t)=d\cos(2\pi t)+r\cos[2\pi(v_t+v_h)t+\alpha] \text{ and}$$

$$y_p(t)=d\sin(2\pi t)+r\sin[2\pi(v_t+v_h)t+\alpha]$$

where the point 0,0 of the x-y reference frame is positioned at the turntable center and where:

r=distance of the point P from the hub center;

$\alpha$=initial angle formed by a straight line between turntable center and point P;

$v_t$=turntable velocity in rpm;

$v_h$=hub velocity in rpm;

d=distance from turntable center and hub center; and t=time.

Applying the formula where the turntable velocity is 200 rpm, and the distance between hub axis AH and turntable axis is 120 mm, the amount of wafer material seen by the pad is symmetric about the hub axis at a hub velocity of 103 rpm. One may also consider the average relative velocity. Factoring in the average relative velocity of the wafer 13 over the pad 34, the theoretical optimum hub velocity for symmetric wear about the hub axis AH is increased to, for example, 115 rpm. It has been found experimentally that the pad life is further improved if the initial hub velocity differs at least slightly from the theoretical optimum hub velocity and the hub velocity for at least some of the successive wafers is increased incrementally wafer by wafer. Preferably then, the hub velocity selected for the first wafer 13 differs from the optimum hub velocity, and more preferably is less than the optimum hub velocity. Also preferably, the hub velocity for a final wafer processed on the polishing pad 34 differs front the optimum hub velocity and more preferably is greater than the optimum hub velocity.

Preferably, the hub velocity selected for each wafer 13 processed between the first and final wafers increases incrementally from the hub velocity of the preceding wafer. For example, where the optimum hub velocity is 115 rpm, the hub velocity for the first wafer is 100 rpm and the hub velocity for the final wafer is 130 rpm. The difference between the hub velocity for the first wafer 13 and the hub velocity for the final wafer is divided by the number of wafers to be processed on the polishing pad 34. For example, if 500 wafers are to be processed on the polishing pad, the difference of 30 rpm is divided by 500 to find the increment (0.06) by which hub velocity is preferably increased for each wafer.

Preferably, the polisher computer automatically controls the hub velocity for the first wafer 13 and for successive wafers, as well as the turntable velocity. The polisher computer is pre-programmed with the turntable velocity and the desired hub velocity for the first wafer 13 and for the successive wafers so that the polisher computer automatically selects the hub velocity for the first wafer and for the successive wafers, including the final wafer. Accordingly, the operator does not need to adjust or otherwise control the hub velocity. Most preferably, the methods of the first and second embodiments are used simultaneously on the wafers.

The methods of both the first and second embodiment produce polished wafers which are flatter and have surfaces which are more parallel than wafers polished according to conventional methods. With respect to the second embodiment, the life of the polishing pad is extended as compared to conventional polishing methods. When both embodiments are used together, which is preferred, the polished wafers are flatter and have surfaces which are more parallel, and the life of the polishing pad is extended.

In view of the above, it will be seen that the several objects of the invention are achieved and other advantageous results attained.

When introducing elements of the present invention or the preferred embodiment(s) thereof, the articles "a" "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A method of polishing semiconductor wafers in a polishing apparatus including a mounting member, a hub having a central hub axis, and a turntable having a central turntable axis offset from the hub axis, the method comprising the steps of:

a) mounting a first wafer on the mounting member, b) securing the mounting member to the hub by drawing a vacuum at a first vacuum pressure through the hub, the first vacuum pressure being held constant during polishing, c) rotating the hub about the hub axis, d) rotating a polishing pad mounted on the turntable about the turntable axis, e) bringing a surface of the wafer and the polishing pad into contact with each other for polishing a surface of the wafer, f) demounting the wafer after polishing of the wafer is complete, g) determining the shape of the polished wafer, h) selecting a second vacuum pressure using information obtained from determining the shape of the first wafer and repeating steps a) through f) for a successive wafer, the second vacuum pressure being substituted for the first vacuum pressure in step b) and being sufficient to deform the mounting member and thereby deform the wafer to improve the flatness and parallelism of the surfaces of the successive wafer.

2. The method of claim 1 wherein the step of determining the shape of the wafer includes determining the roll-off value for the wafer.

3. The method of claim 2 wherein the step of selecting a second vacuum pressure includes multiplying the roll-off value by an experimentally obtained multiplier to obtain a delta pressure value, the delta pressure value thereafter being applied to the first vacuum pressure to select the second vacuum pressure.

4. The method of claim 1 wherein the step of selecting the second vacuum pressure is controlled automatically by a computer.

5. The method of claim 1 further comprising selecting a hub velocity for the first wafer and a new hub velocity for a plurality of successive wafers, rotating the hub about the hub axis at the selected hub velocity for the first wafer and said successive wafers and maintaining the hub velocity substantially constant during polishing of the first wafer and said successive wafers, the hub velocity for the first wafer and said successive wafers being selected such that the polishing pad is worn substantially symmetrically about the hub axis during polishing of the first wafer and successive wafers and thereby extending the useful life of the polishing pad and improving the flatness of the wafers produced.

6. A method of polishing semiconductor wafers in a polishing apparatus including a mounting member, a hub having a central hub axis, and a turntable having a central turntable axis offset from the hub axis, the method comprising the steps of:

a) mounting a first wafer on the mounting member, b) securing the mounting member to the hub, c) selecting a hub velocity for the first wafer, d) rotating the hub about the hub axis at the hub velocity and maintaining the hub velocity substantially constant during polishing of the first wafer, e) rotating a polishing pad mounted on the turntable about the turntable axis at a constant turntable velocity, f) bringing a surface of the first wafer and the polishing pad into contact with each other for polishing a surface of the wafer, g) demounting the first wafer after polishing of the wafer is complete, h) repeating steps a) through g) for successive wafers, the method of this step including selecting a new hub velocity for at least one of said successive wafers and rotating the hub about the hub axis at the new hub velocity, the new hub velocity differing from the hub velocity selected for a preceding wafer such that the polishing pad is worn substantially symmetrically about the hub axis during polishing of the successive wafers and thereby extending the useful life of the polishing pad and maintain the flatness of the wafers produced.

7. The method of claim 6 wherein the method further includes the step of mathematically determining an optimum hub velocity at which the polishing pad is theoretically worn symmetrically about the hub axis, the hub velocity selected being different than the optimum hub velocity for at least some of the wafers.

8. The method of claim 7 wherein the hub velocity selected for the first wafer of the set of silicon wafers is less than the optimum hub velocity and the hub velocity selected for a final wafer of the set of silicon wafers is greater than the optimum hub velocity.

9. The method of claim 6 wherein the new hub velocity differs from the hub velocity selected for the immediately preceding water.

10. The method of claim 6 wherein a new hub velocity is selected for each successive wafer, the new hub velocity being selected by adding a predetermined increment to the hub velocity selected for the immediately preceding wafer.

11. The method of claim 8 wherein the mounting member is secured to the hub by drawing a vacuum at a first vacuum pressure.

12. The method of claim 11 further comprising the steps of determining the shape of the wafer and selecting a second vacuum pressure using information obtained from determining the shape of the first wafer, the second vacuum pressure being of sufficient pressure to deform the mounting member and thereby deform the wafer, and further comprising the step of substituting the second vacuum pressure for polishing of at least one of said successive wafers.

13. The method of claim 12 wherein the step of determining the shape of the wafer includes determining the roll-off value for the wafer.

14. The method of claim 13 wherein the step of selecting a second vacuum pressure includes multiplying the roll-off value by an experimentally obtained multiplier to obtain a delta pressure value, the delta pressure value thereafter being applied to the first vacuum pressure to select the second vacuum pressure.

15. A method of polishing semiconductor wafers in a polishing apparatus including a mounting member, a hub having a central hub axis, and a turntable having a central turntable axis offset from the hub axis, the apparatus further including a computer connected electronically to a measuring machine, the method comprising the steps of:

a) mounting a first wafer on the mounting member, b) securing the mounting member to the hub by drawing a vacuum at a first vacuum pressure through the hub, the computer having selected the first vacuum pressure, c) rotating the hub about the hub axis, d) rotating a polishing pad mounted on the turntable about the turntable axis, e) bringing a surface of the wafer and the polishing pad into contact with each other for polishing a surface of the wafer, f) demounting the wafer after polishing of the wafer is complete, g) determining the roll-off value of the polished wafer using the measuring machine, the measuring machine signaling the roll-off value to the computer, h) the computer automatically selecting a second vacuum pressure using the roll-off value of the first wafer, h) repeating steps a) through f) for a successive wafer, the second vacuum pressure being substituted for the first vacuum pressure in step b) and being sufficient to deform the mounting member and thereby deform the wafer to improve the flatness and parallelism of the surfaces of the successive wafer.

16. The method of claim 15 wherein the computer multiplies the roll-off value by an experimentally obtained multiplier to obtain a delta pressure value, the delta pressure value thereafter being applied to the first vacuum pressure to select the second vacuum pressure.

17. The method of claim 16 wherein a plurality of successive wafers are processed, and wherein the computer automatically selects a hub velocity at which the hub is rotated, the computer being pre-programmed to hold the hub velocity constant during polishing of the first wafer and pre-programmed to incrementally increase the hub velocity during polishing of at least some of the successive wafers.

* * * * *